United States Patent [19]

Geczy

[11] Patent Number: 4,501,521

[45] Date of Patent: Feb. 26, 1985

[54] LOCKING FASTENER ASSEMBLY

[75] Inventor: Bela A. Geczy, Orange, Calif.

[73] Assignee: Smith International, Inc., Newport Beach, Calif.

[21] Appl. No.: 365,633

[22] Filed: Apr. 5, 1982

[51] Int. Cl.[3] ..... F16B 39/06

[52] U.S. Cl. ..... 411/217; 175/107; 285/89; 403/322; 411/221

[58] Field of Search ..... 411/190, 191, 192, 195, 411/196, 197, 204, 208, 216, 217, 218, 219, 221, 248, 249, 321, 322, 323; 285/89; 403/322; 175/107

[56] References Cited

U.S. PATENT DOCUMENTS

| | | | |
|---|---|---|---|
| 1,701,511 | 2/1929 | Sisk | 411/219 |
| 1,865,637 | 7/1932 | Lear | 411/322 X |
| 2,956,604 | 10/1960 | Crotty | 411/322 |
| 3,475,040 | 10/1969 | Gratt | 411/249 X |
| 3,851,690 | 12/1974 | Wing et al. | 411/190 |

FOREIGN PATENT DOCUMENTS

| | | | |
|---|---|---|---|
| 3024 | of 1909 | United Kingdom | 411/204 |

*Primary Examiner*—Thomas J. Holko
*Attorney, Agent, or Firm*—Christie, Parker & Hale

[57] ABSTRACT

A locking fastener assembly has a fastener with a generally cylindrical body with external threads for assembly with a hollow outer member. Crenellations are provided at a first end of the body for engaging an inner member in the hollow member for preventing rotation of the inner member relative to the locking fastener. At the other end of the body there is a radially extending flange carrying an interrupted annular rim which defines an annular channel between the body and the rim. A locking ring can fit substantially entirely into the annular channel. The ring has a plurality of projections which fit into a plurality of radial slots in the rim for preventing relative rotation between the locking ring and fastener. A snap ring or the like can be used for releasably spacing the locking ring away from the bottom of the annular channel so that the projections on the ring can engage projections on the outer member and prevent relative rotation between the outer member and the split ring.

15 Claims, 5 Drawing Figures

LOCKING FASTENER ASSEMBLY

FIELD OF THE INVENTION

This invention relates to a locking fastener assembly for preventing relative rotation between an outer tube and an inner member.

RELATED APPLICATIONS

This application is related to my U.S. patent application Ser. No. 365,614, filed Apr. 5, 1982 entitled THRUST BEARING ASSEMBLY FOR A DOWNHOLE DRILL MOTOR filed concurrently herewith. The related application describes use of a locking fastener assembly as described and claimed herein in a thrust bearing assembly for a downhole, fluid powered motor for drilling bore holes in the earth for oil and gas wells or the like. The related application is hereby incorporated by reference.

BACKGROUND

There are occasions when it is desirable to prevent relative rotation between an outer tube and an inner member coaxial therewith. For example, in a bearing assembly for a downhole fluid powered motor for drilling oil wells, it can be desirable to prevent relative rotation between a stationary bearing sleeve and its surrounding housing. A number of techniques have been tried or might be used for this purpose, but there have been continuing problems due to the severe environment in which such an assembly must operate.

For example, in one embodiment a locking ring has been provided between a housing and a bearing sleeve. The ring was connected in place by four bolts. During service, such bolts can become dislodged, thereby releasing the locking ring and damaging the bearing assembly. Another unacceptable solution is to apply a threaded nut and weld the nut to the housing. This results in obvious difficulties in disassembly. Other arrangements with lock wires, roll pins, and the like are also unsuitable.

It is, therefore, desirable to provide a locking fastener assembly which is secure and not subject to disassembly due to vibration, torque, or moderate wear. The locking fastener assembly should be easily applied and removed when desired.

BRIEF SUMMARY OF THE INVENTION

There is, therefore, provided in practice of this invention according to a presently preferred embodiment a locking fastener assembly wherein the fastener has a generally cylindrical body with threads for assembly with a hollow outer member. Means are provided at a first end of the body for engaging an inner member in the hollow member for preventing rotation of the inner member relative to the locking fastener. At the other end of the body there is a radially extending flange carrying an interrupted annular rim which defines an annular channel between the body and the rim. A locking ring can fit substantially entirely into the annular channel. The ring has a plurality of projections which fit into a plurality of radial slots in the rim for preventing relative rotation between the locking ring and fastener. A snap ring or the like can be used for releasably spacing the locking ring away from the bottom of the annular channel so that the projections on the ring can engage projections on the outer member and prevent relative rotation between the outer member and the split ring.

DRAWINGS

These and other features and advantages of the present invention will be further appreciated as the same becomes better understood by reference to the following detailed description of a presently preferred embodiment when considered in connection with the accompanying drawings wherein.

DESCRIPTION

Figure 1:
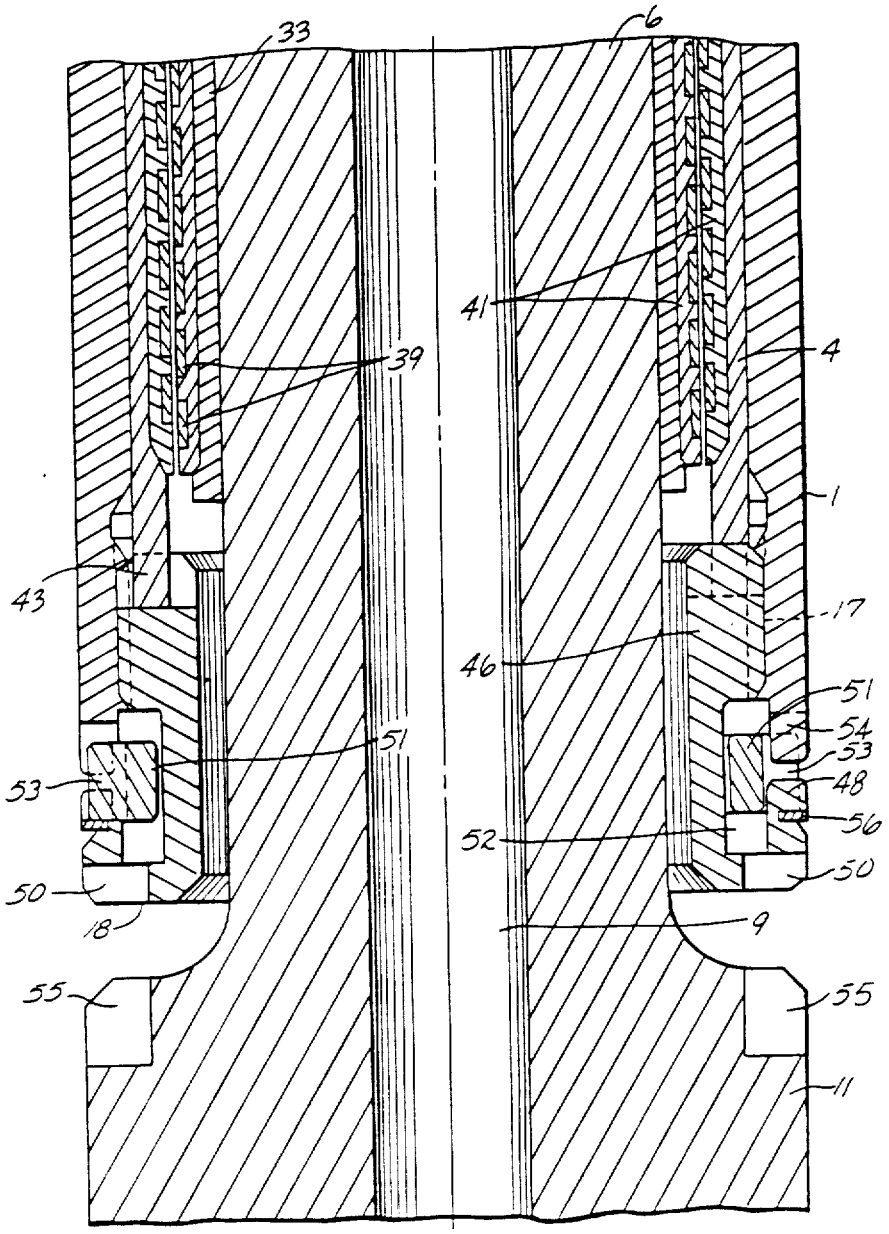
FIG. 1 is a longitudinal cross section of the lower end of a bearing assembly for a downhole drilling motor.
Figure 2:
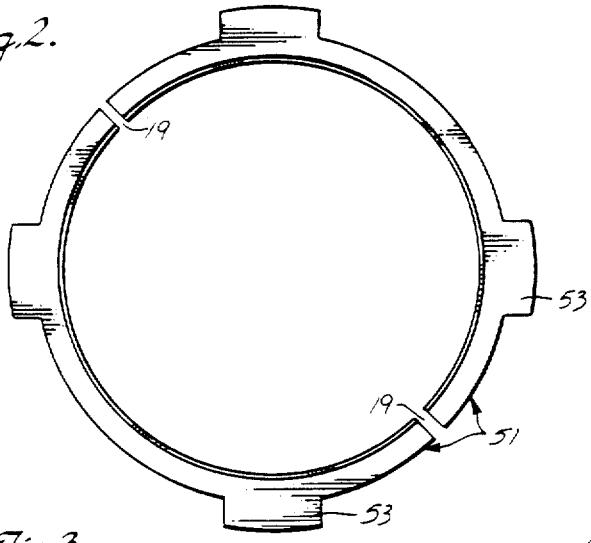
FIG. 2 is a view of one face of a split locking ring of a locking fastener assembly on the lower end of the bearing assembly.

The bottom portion of a thrust bearing assembly for a downhole fluid motor is illustrated in longitudinal cross-section in FIG. 1. The balance of the bearing assembly is described and illustrated in the aforementioned patent application. The bearing assembly has a generally tubular housing 1 within which is mounted a rotatable shaft 6. A fluid passage 9 through the shaft conducts drilling fluid from a downhole hydraulic motor on the upper end of the assembly to a rock bit mounted on an enlargement 11 at the lower end of the shaft.

Insofar as illustrated in FIG. 1, the shaft is mounted in the housing by an inner rotatable radial journal bearing sleeve 33 and an outer stationary radial journal bearing sleeve 4. Each of these sleeves has a plurality of tungsten carbide inserts 39 in a mounting matrix 41 to provide a hard bearing interface. The rotatable journal bearing sleeve 33 rotates with the shaft and is secured to the shaft by an eccentric mounting (not shown). The stationary journal bearing sleeve 4 is fixed relative to the housing by a locking fastener assembly as provided in practice of this invention.

Figure 3:
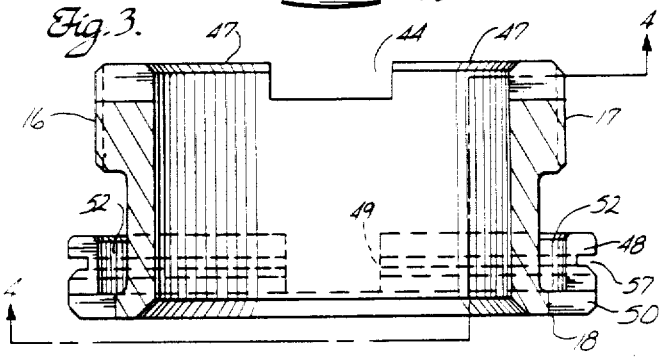
FIG. 3 is a longitudinal cross section of a locking fastener for the assembly.
Figure 4:
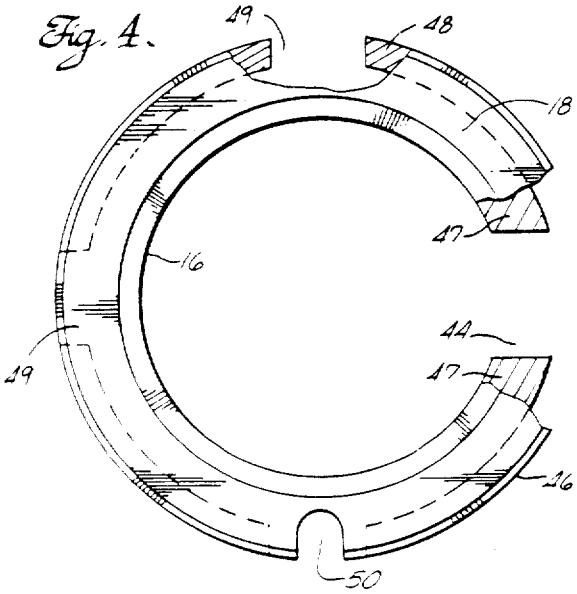
FIG. 4 is a view of one face of the locking fastener partially cut away.
Figure 5:
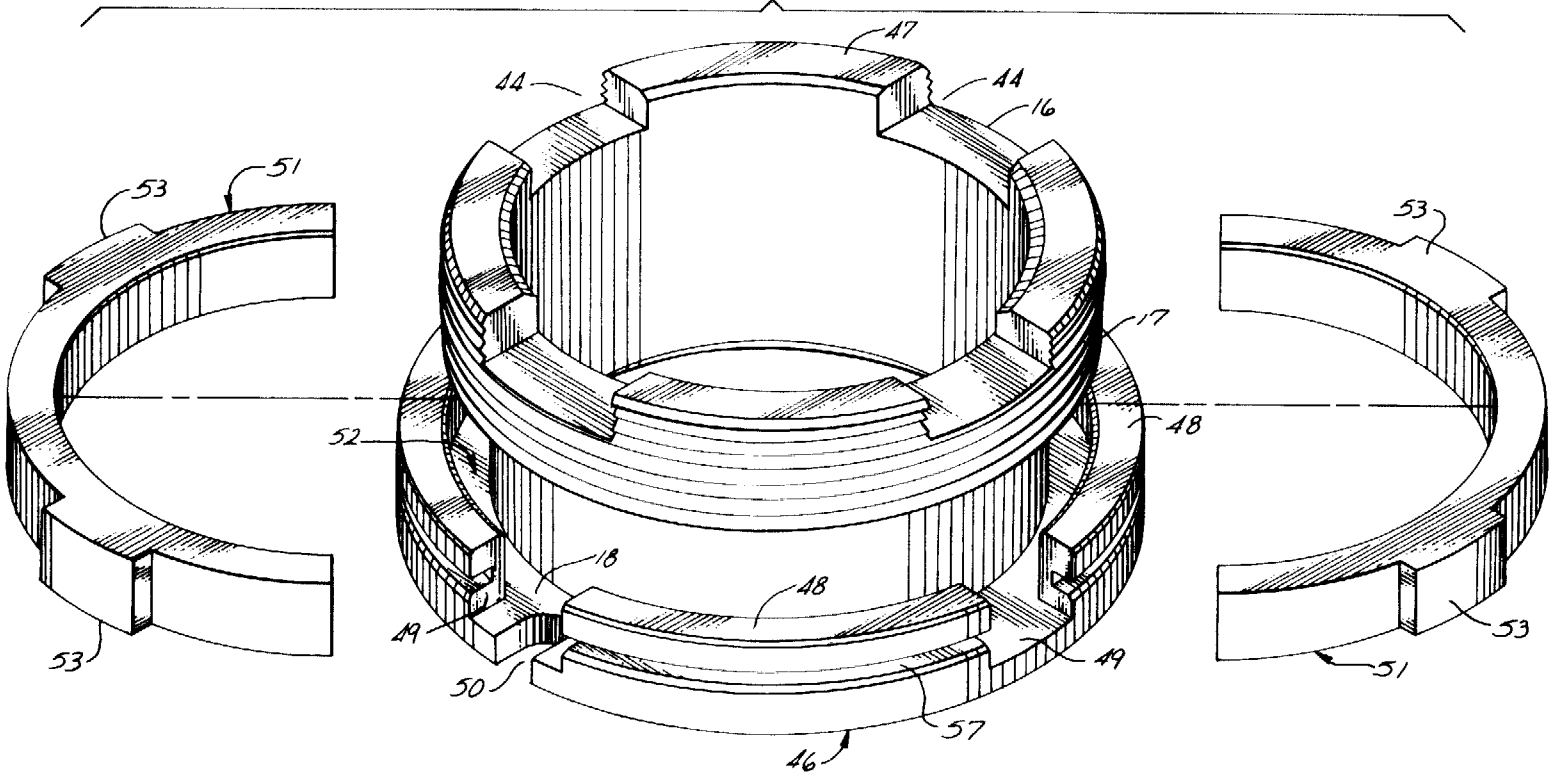
FIG. 5 is an isometric exploded view of the locking fastener and split ring.

The lower end of the radial bearing sleeve is crenellated with alternating slots and projections. It has four longitudinal extensions 43 that fit into four more or less radial slots 44 in the upper end of a crenellated locking fastener 46 which is illustrated in greater detail in FIGS. 3 to 5. The extensions 43 on the bearing sleeve engage extensions 47 between the slots 44 on the locking fastener, thereby preventing relative rotation between the sleeve and fastener.

The nut has a generally cylindrical body 16 having external threads 17 at its upper end for threading into the lower end of the housing 1. At the lower end of the body, there is a radially extending flange 18 which carries an interrupted upstanding circumferential rim 48 extending toward the upper end. The rim is subdivided by four more or less radial slots 49. This defines a recessed annulus 52 between the upstanding rim 48 and the body of the locking fastener.

A split locking ring 51 has inside and outside diameters that permit it to fit into the recessed annulus. The length of the split ring is about the same as the depth of the annulus so that it can fit substantially entirely into the annulus. The split ring has four radial lugs or projections 53 which fit into the slots 49 in the upstanding rim of the fastener. Thus, the ring is constrained against rotation relative to the fastener.

The split ring is preferably formed with two radial slits subdividing the ring into two similar halves. The two projections 53 on each half of the ring are each about 45° from a slit 19 so that the halves of the ring are identical.

A pair of diametrically opposite slots are formed in the flange at the bottom of the locking fastener. The slots can be aligned with similar slots 55 in the top of the shaft enlargement 11. Dowel pins (not shown) can be temporarily placed in the aligned slots and the shaft can be rotated relative to the housing to serve as a "wrench" for manipulating the locking fastener.

When the bearing assembly is being assembled, the split locking ring remains in the annulus 52 as the locking fastener is threaded into the lower end of the housing to its desired position. The projections 47 on the upper end of the locking fastener engage the projections 43 on the bottom of the radial journal bearing sleeve so that it, too, rotates relative to the housing during assembly. Preferably, the locking fastener is tightened until stopped by the radial journal bearing sleeve and then backed off slightly to leave the sleeve and other parts of the bearing assembly sufficiently free to be self-aligning.

When the locking fastener has been assembled to its desired position in the housing, it is then locked in place by the split locking ring. The split locking ring is lifted away from the bottom of the annulus so that the projections 53 on the ring mate with projections 54 on the lower end of the housing. The split locking ring is maintained in its position spaced away from the flange 18 by a retaining ring 56 which snaps into a circumferential groove 57 on the outside of the rim of the locking fastener. In this position, the projections on the split locking ring engage both the upstanding rim 48 on the locking fastener and the crenellations 54 on the lower end of the housing, thereby preventing relative rotation between the locking fastener and housing. The crenellated connection between the upper end of the locking fastener and the lower end of the radial bearing sleeve 4 assures that the bearing sleeve does not rotate in the housing.

The locking fastener can be removed for disassembly of the bearing assembly by removing the snap ring 56, which permits the split locking ring to be moved into the annulus. Once the split locking ring is disengaged from the crenellations at the lower end of the housing, the locking fastener can be threaded out of the housing.

Although but one embodiment of locking fastener constructed according to principles of this invention has been described and illustrated herein, many modifications and variations will be apparent to those skilled in the art. Thus, for example, the locking ring can be keyed to the fastener to permit axial sliding and prevent relative rotation by means separate from the means by which the ring engages the housing. In an alternative embodiment, a captive ring can be assembled on the fastener rather than using a removable split ring. An intact locking ring could be used, for example, where the outer member has a smaller inside diameter and the ring could fit over the threaded portion of the fastener to permit assembly onto the fastener before the fastener is threaded into an outer member.

An arrangement can be made where the fastener threads cover the outside of the outer member, in which case the locking ring can engage both the inner and outer members as well as the locking fastener to prevent relative rotation. The illustrated arrangement is preferred since the outside diameter of the locking fastener assembly is no more than the diameter of the housing, thereby minimizing resistance to fluid flow around the assembly and avoiding a prominent location for wear.

It is, therefore, to be understood that within the scope of the appended claims, this invention may be practiced otherwise than as specifically described.

What is claimed is:

1. A locking fastener assembly comprising:

a locking fastener having threads for assembly with an outer member and means at one end for engaging an inner member and preventing rotation of such an inner member relative to the fastener;

a ring on the fastener having projections engaging the fastener for preventing relative rotation between the ring and fastener, the ring having locking means and being axially slidable on the fastener between an unlocked position spaced away from such an outer member and a locked position having the locking means in engagement with such an outer member for preventing relative rotation between such an outer member and the ring; and means for temporarily retaining the ring in the locked position.

2. A locking fastener assembly as recited in claim 1 wherein the ring in the locked position is at least in part inside such an outer member and at least in part inside a portion of the fastener.

3. A locking fastener assembly as recited in claim 2 wherein the ring is split for assembly on the fastener.

4. A locking fastener assembly as recited in claim 1 wherein the threads are external threads for assembly within such an outer member.

5. A locking fastener assembly as recited in claim 1 wherein the projections and the locking means comprise a plurality of generally radial external projections on the ring for engaging generally radial slots on the fastener and on such an outer member.

6. A locking fastener assembly as recited in claim 5 wherein the nut comprises an outer circumferentially extending upstanding rim interrupted by said slots and having an axial length about the same as the length of the ring.

7. A locking fastener assembly as recited in claim 6 wherein the ring is split for assembly on the locking fastener and fits into an annulus between the upstanding rim and the balance of the locking fastener.

8. A locking fastener assembly comprising:

a locking fastener comprising:

a generally cylindrical body, means at a first end of the body for engaging an inner member and preventing rotation of such an inner member relative to the locking fastener, threads on the first end of the body for assembly with an outer member surrounding such an inner member, a radially extending flange at a second end of the body, and an interrupted annular rim on the flange extending away from the second end defining an annular channel between the body and the rim, the interrupted rim having a plurality of radial slots;

a locking ring comprising an annular body having inside and outside diameters and a length sufficiently short to fit substantially entirely into the annular channel and a plurality of projections for fitting into the radial slots in the rim for preventing relative rotation between the locking ring and the fastener; and means for releasably spacing the locking ring away from the bottom of the annular channel so that the projections can engage such an outer member and prevent relative rotation between such an outer member and the split ring.

9. A locking fastener assembly as recited in claim 8 wherein the locking ring comprises at least a pair of slits for subdividing the ring into segments for assembly into the annular channel.

10. A locking fastener assembly as recited in claim 9 wherein there are four radial slots in the rim and the split locking ring comprises four projections, each of said projections being about 45° circumferentially from such a slit.

11. A locking fastener assembly as recited in claim 8 wherein the means for spacing the locking ring away from the bottom of the channel comprises an external circumferential groove on the upstanding rim and a retaining ring fittable into the groove.

12. A locking fastener assembly as recited in claim 8 wherein the threads are external threads for assembly within such an outer member.

13. A locking fastener assembly as recited in claim 8 wherein the means for engaging an internal member comprise a plurality of alternating longitudinal projections and slots for mating with slots and projections on such an inner member.

14. A locking fastener assembly comprising:

a fastener comprising:

a generally cylindrical body, a plurality of alternating projections and slots at a first end of the body for engaging slots and projections on an inner member and preventing rotation of such an inner member relative to the locking fastener, external threads on the first end of the body for assembly of the fastener within a hollow outer member surrounding such an inner member, a radially extending flange at a second end of the body, a circumferentially extending rim on the flange extending away from the second end and defining an annular channel between the body and the rim, a circumferentially extending groove on the outside of the rim, and a plurality of radial slots in the rim;

a split locking rim comprising:

an annular body having inside and outside diameters and a length sufficiently short to fit substantially entirely into the annular channel, a plurality of radial projections for fitting into the radial slots in the rim for preventing relative rotation between the split locking ring and the fastener, and at least a pair of slits subdividing the ring into segments for assembly into the annular channel; and a removable retaining ring for releasably spacing the split locking ring away from the bottom of the annular channel so that the projections can engage such an outer member and prevent relative rotation between such an outer member and the split ring.

15. A locking fastener assembly as recited in claim 14 wherein the split ring comprises four radial projections, each of such projections being about 45° from one of said slits.

* * * * *